US008528734B1

(12) United States Patent
Mohar et al.

(10) Patent No.: US 8,528,734 B1
(45) Date of Patent: Sep. 10, 2013

(54) NOVELTY MAILING RECEPTACLE AND METHOD OF MAKING SAME

(71) Applicants: Kathy Mohar, Tijeras, NM (US); Serena Cardenas, Albuquerque, NM (US)

(72) Inventors: Kathy Mohar, Tijeras, NM (US); Serena Cardenas, Albuquerque, NM (US)

( * ) Notice: Subject to any disclaimer, the term of this patent is extended or adjusted under 35 U.S.C. 154(b) by 0 days.

(21) Appl. No.: 13/766,124

(22) Filed: Feb. 13, 2013

(51) Int. Cl.
*B65D 73/00* (2006.01)

(52) U.S. Cl.
USPC ..... 206/457; 53/452

(58) Field of Classification Search
USPC ..... 206/457; 53/473, 474, 452, 467, 53/128.1; 229/92.8
See application file for complete search history.

(56) References Cited

U.S. PATENT DOCUMENTS

| | | | | |
|---|---|---|---|---|
| 2,971,292 | A * | 2/1961 | Malecki | 47/58.1 R |
| 4,795,033 | A * | 1/1989 | Duffy | 206/457 |
| 4,951,404 | A * | 8/1990 | Lithwick | 40/124.06 |
| 5,308,630 | A * | 5/1994 | Nordahl | 426/270 |
| 5,709,827 | A * | 1/1998 | Andersen et al. | 264/42 |
| 5,783,126 | A * | 7/1998 | Andersen et al. | 264/102 |
| 6,422,388 | B1 * | 7/2002 | McCahey | 206/457 |
| 2004/0007490 | A1 * | 1/2004 | Bowman et al. | 206/457 |
| 2005/0120915 | A1 * | 6/2005 | Bowden et al. | 106/162.5 |
| 2008/0254080 | A1 * | 10/2008 | Glynson et al. | 424/404 |

* cited by examiner

*Primary Examiner* — Jacob K Ackun
(74) *Attorney, Agent, or Firm* — Rod D. Baker

(57) ABSTRACT

A novelty mailing item fabricated from an article of fresh produce. An article of produce, such as a chili pepper, is provided with a hollow interior and then treated with preservatives, plaster of Paris, and resin coatings to increase structural integrity and to retard decomposition of the produce. The treated article of produce may feature an interior cavity in which a gift or message may be contained, or may feature an exterior writing surface upon which a message may be written. The novelty mailing item or container may be labeled for mailing or shipping to an addressee recipient.

17 Claims, 7 Drawing Sheets

NOVELTY MAILING RECEPTACLE AND METHOD OF MAKING SAME

FIELD OF THE INVENTION

Technical Field

The present invention relates to novelty packaging, particularly mailing containers, and more specifically to a mailing container made from a chili pepper or similar item of produce.

BACKGROUND OF THE INVENTION

There is a long tradition of sending not only communications, but gifts as well, via post office mail. It is known sometimes to combine or merge a gift or message with the container in which it is transmitted, the shipping container being part of the overall gift to the receiver. Some such novelties include writing messages upon unusual three-dimensional items, placing an address on the item, and mailing the item by parcel post, first class, etc., delivery to the recipient.

A long-known gift device of this general type is to write a message and address upon the exterior of a natural coconut, and to mail the coconut to a friend or loved one. Typically such message gifts are suggestive of the locale from which the message is mailed. For example, coconuts may be mailed from a tropical location to recipients in temperate areas. Small stones, bottles with exotic labels, and other unusual items have been similarly used as the medium/container for sending small gifts and/or messages. It also is known to place a gift, such as currency (or a written message) inside a puzzle box, in which the recipient must determine and perform a tricky procedure in order to access the interior of the box and obtain her gift or message.

The presently disclosed apparatus was developed in view of the foregoing background, and is an advance in the art of novelty mail containers. As disclosed, the present invention permits a perishable produce, particularly a chili pepper, to serve as a mailing container.

BRIEF DESCRIPTION OF THE DRAWINGS

The attached drawings, which form part of the disclosure, are as follows.

Like label numerals are used to identify like elements throughout the drawings. The drawings, which are not necessarily to scale in a view or between views, are intended to illustrate a preferred embodiments of the invention, but do not limit the invention.

SUMMARY OF THE INVENTION

Figure 1:
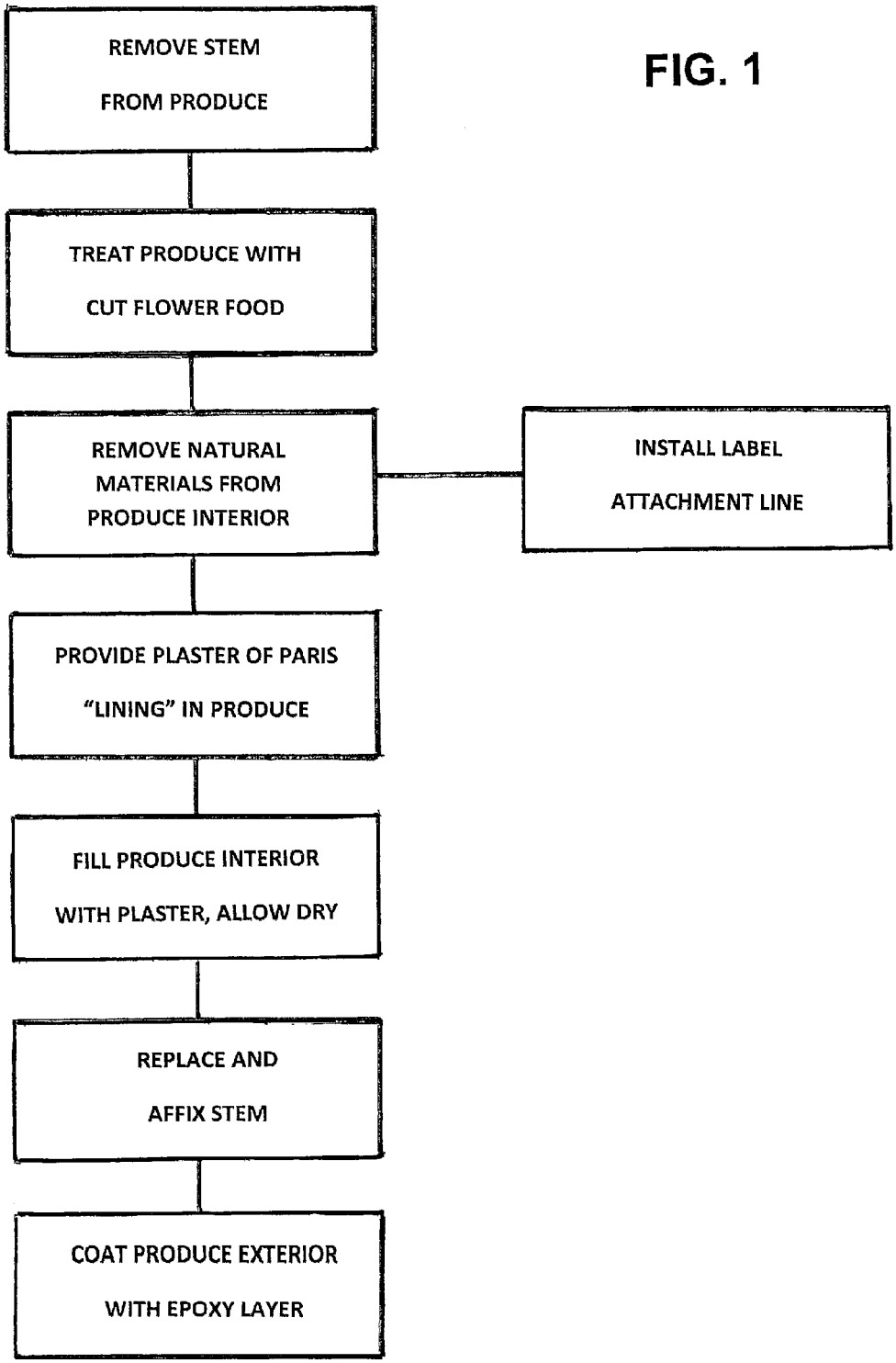
FIG. 1 is schematic chart depicting selected principal steps of a method according to the invention for making a mailing postcard from an article of produce.

There is disclosed hereby a novelty mailing apparatus made from an article of produce, preferably but not necessarily a chili pepper, and the method of making it. The method includes a process for making a "postcard" embodiment of the novelty mailing apparatus. The postcard produce mailing version is made to have a message written upon its exterior surface. The method also includes a process for making a "container" embodiment of the novelty mailing apparatus, which is made to have a cavity therein which may receive an article (such as a small gift) to be transmitted and delivered to the recipient. It is further contemplated that a novelty apparatus according to the present disclosure alternatively may be beneficially used in floral arrangements.

The apparatus and method were developed to enhance and preserve the structural integrity of a natural produce novelty shipping/mailing article, while also significantly slowing the decomposition process of the produce article. So strengthened and temporarily preserved, the article is prepared for mailing/shipment. The methods of making include the use of plaster of Paris to provide plaster linings to the produce mailing apparatus, and to fill or partially fill the interior of the produce mailing apparatus, to lend overall structural support. A label attachment line optionally but preferably is securely installed upon the apparatus, which line may be used to attach a mailing address card/label to the apparatus. Also, steps are disclosed for cleaning and preserving the apparatus, including the coating of the apparatus exterior with a layer of polymer resin or epoxy.

"Mailing" in this context merely means transporting to an addressee, whether the transportation is via public domestic or international mailing services, or via some manner of private courier or delivery service. When either the container version or the postcard version of the apparatus is completely made, it may be used to transmit a message to the intended recipient. The container version also may be used as a container to ship a small item. The postcard or container mailing apparatus is fashioned from an item of produce, and retains its appearance, thus providing a novelty mailing apparatus.

DETAILED DESCRIPTION OF THE INVENTION (INCLUDING BEST MODE FOR PRACTICING THE INVENTION)

The present invention is of a novelty mailing container and methods for making it. There also is disclosed a novelty produce postcard, and methods for making it, upon which a message may be written prior to mailing. The novelty mailing/shipping container, or the novelty postcard, embodies an article of fresh produce.

It may be desired to send via the public mail or private courier a written message and/or an item, such as a small gift, souvenir, or memento, to a recipient by means of a novel or unusual writing surface, or by means of a container fashioned from an article of fruit or vegetable produce. If an article of produce treated according to this disclosure is intended for use to convey an item such as a small gift, it is referred to as a "container"; if it is merely to provide a surface upon which a message is to be written, it is called a "postcard". The invention thus relates to both a produce mailing container and to a produce mailing postcard.

This disclosure contemplates that the article of produce is a chili pepper, although the techniques and methods of the invention are not so limited, and may find use with other articles of fruit or vegetable produce, such as small gourds for example, whether or not edible. Substantially hollow produce, that is, produce that when fresh has a rind, shell, or other fleshy walled body enclosing a mostly open interior, are very preferred. The article of produce has a stem end from which emerges the natural stem by which the produce is attached to its parent plant or vine. On the opposite end or side of the produce body is the tip end, which may or may not terminate in a relatively narrow point, depending upon the article of produce selected.

The container embodiment and the postcard embodiment are similar in many respects, except that the postcard embodiment is nearly or completely filled so as not to leave any void or cavity therein, while the container embodiment is configured with an interior cavity space in which an item (e.g., a small gift, a scrolled or rolled paper bearing a message, a memento, or the like) may be placed. Further, the postcard embodiment typically may be relatively smaller in overall size than the container embodiment. If the postcard embodiment is contemplated, it is preferable that an article of produce be selected that features a suitable writing surface on its exterior, e.g., relatively flat in general surface contour, and sufficiently smooth so as to accept legible writing directly thereon, as with an ink pen, specialized marker, crayon, or the like. As the postcard embodiment is coated with a layer of epoxy, in use it may be desirable to obtain a specialized writing tool capable of laying down a permanent message upon a smooth, mostly nonporous resin such as a cured epoxy. The container embodiment may be fashioned from any acceptably sized and shaped article of produce, provided the produce is large enough for an interior volume allowing a cavity space in which the desired article may be inserted for conveyance.

An apparatus according to the present disclosure need not actually be mailed or shipped. An article of produce preserved and strengthened accordingly may be used decoratively, for example in a floral arrangement, or in a seasonal or horticultural display.

In a preferred embodiment, the article of produce is a chili pepper of any suitable species and color. Ripe, red chili peppers are particularly desirable for use. A chili pepper offers a unique and distinct visual impression, and may be particularly appealing to users wishing to transmit a novelty or souvenir container or postcard from, for example, the American Southwest where red chili peppers are culturally emblematic. The produce, of whatever type/species, to be treated according to the invention, preferably is selected from fresh, comparatively unblemished produce.

Figure 3:
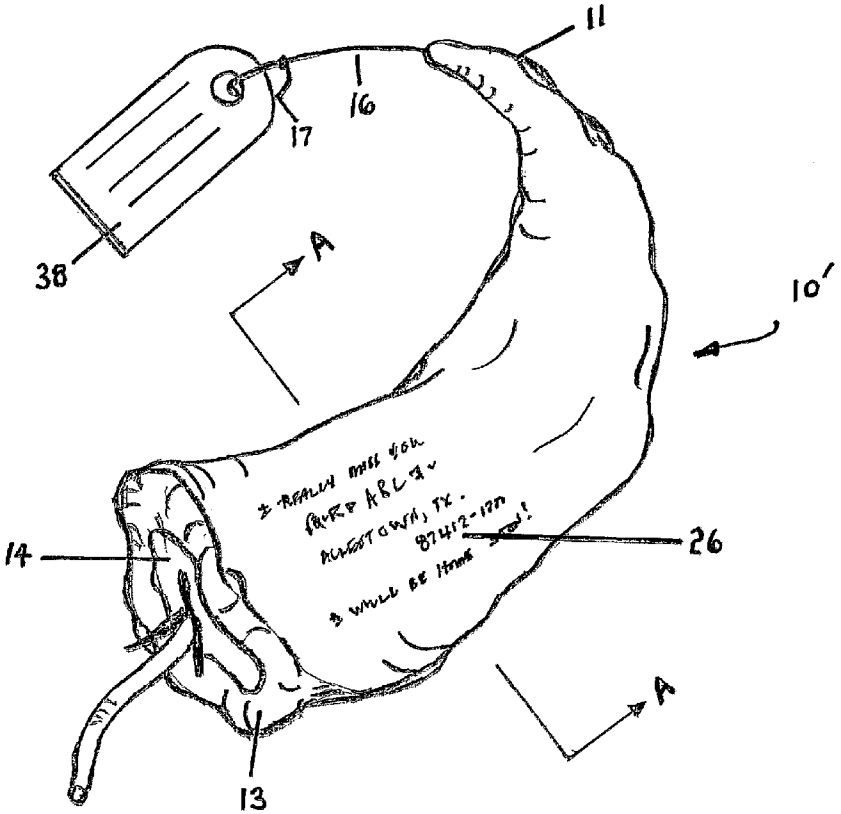
FIG. 3 is a perspective view of an embodiment of a mailing postcard fashioned from a chili pepper according to the present invention.
Figure 3A:
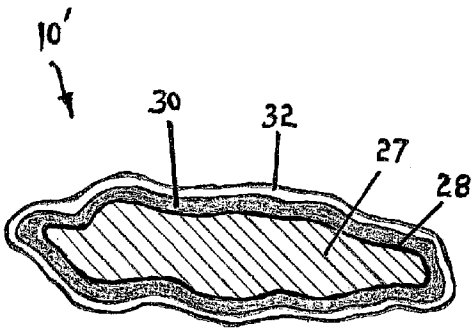
FIG. 3A is a sectional view of the chili pepper mailing postcard seen in FIG. 3, taken along section A-A in FIG. 3.
Figure 4:
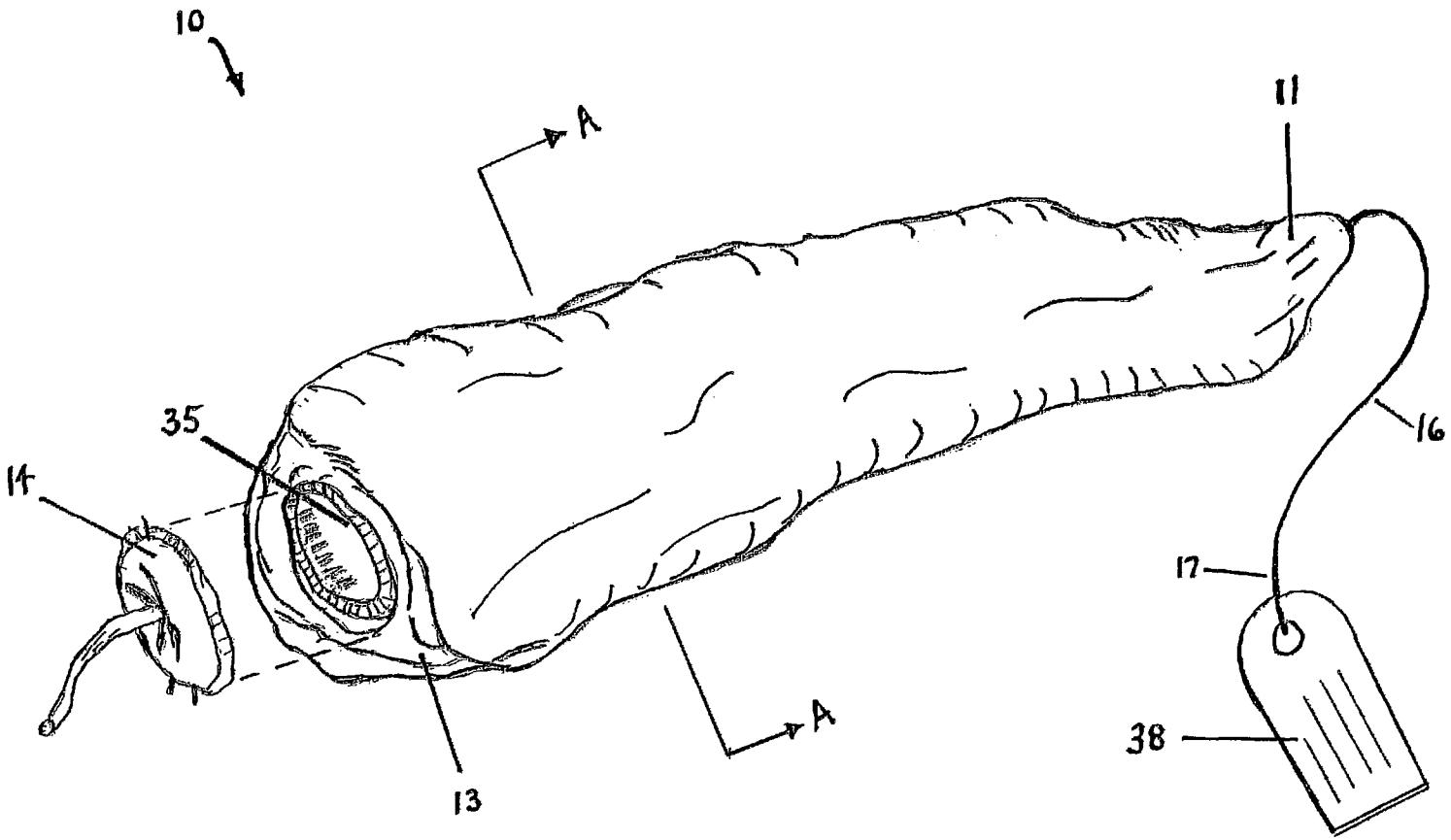
FIG. 4 is a perspective, partially exploded, view of an embodiment of a mailing container fashioned from a chili pepper according to the present invention.
Figure 4A:
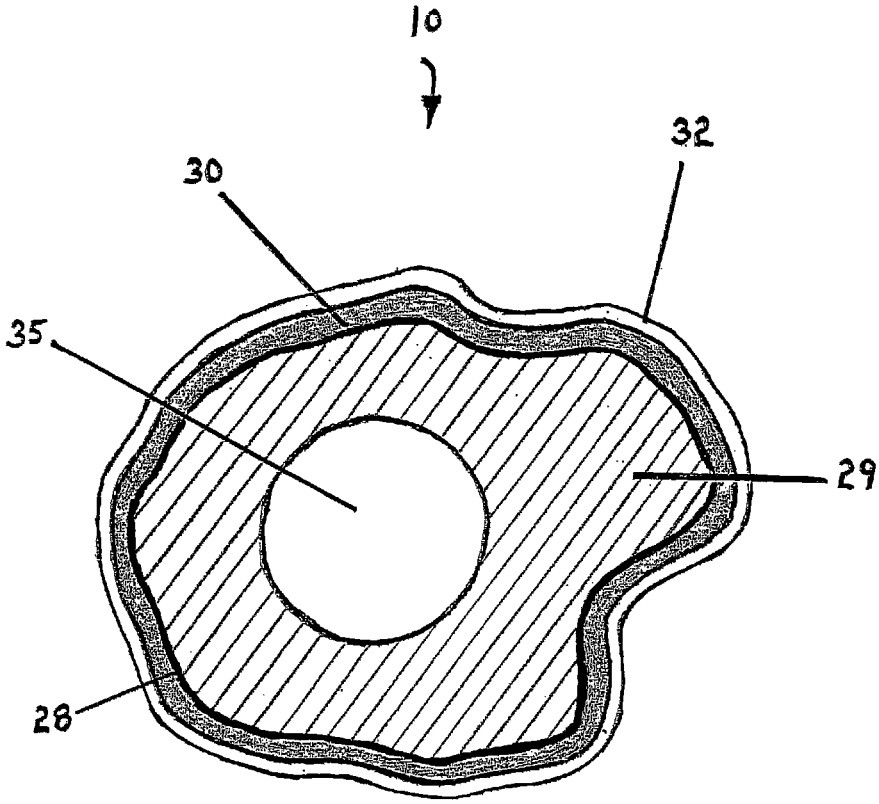
FIG. 4A is a sectional view of the chili pepper mailing container seen in FIG. 4, taken along section A-A in FIG. 4.

If chili peppers are selected, peppers to serve as containers should be very generally circular conical in shape (narrow at the tip end, broader at the base or stem end), and generally straight along the principal axis (see FIGS. 4 and 4A). Container produce preferably is relatively large in size, for example at least about three inches long and at least about two inches in average diameter or lateral breadth; most preferably the size of a "large" container produce is between approximately four and approximately ten inches long, and between about two inches and about four inches in average diameter or lateral breadth. Articles of produce contemplated for use as message postcards can be comparatively smaller than the dimensions offered above respecting containers, but nevertheless are preferably at least about three inches long and at least about 1.5 inches in average diameter or lateral breadth. As mentioned, a preferred embodiment of a postcard produce features a flatter surface, such as somewhat flattened chili pepper having an overall shape of a cone having a markedly ovoid radial section (see FIGS. 3 and 3A).

Succinctly characterized, the invention includes a method for treating and preparing an article of produce, preferably a chili pepper, to function as a novelty mailing container or postcard. The stem of the article of produce is carefully removed, as by excision, to permit the evacuation of the article's naturally occurring interior materials, such as seeds, seed vein(s), loose pulp, etc. The emptied produce is then treated to strengthen and preserve it for use as a container or postcard. Treatment includes steps whereby plaster of Paris is used to dry and strengthen the body and the stem of the produce. A plaster of Paris mix useable in the practice of the invention is available from DAP Products Inc. of Baltimore, Md. 21224, and at www.dap.com. Further, steps are undertaken to provide a clear (e.g. visually substantially transparent when cured) coating of polymer or epoxy upon the exterior of the article of produce, also to promote strength, preservation, and sanitary use of the produce as a container or postcard. A very suitable epoxy mix kit is ENVIROTEX LITE® brand pour-on high gloss finish product. The ENVOROTEX LITE® product is a clear reactive polymer compound; it cures to a thick, glossy coating in about 8 hours at 70° F., and reaches full strength and toughness in about 48 hours. The product is available from Environmental Technology, Inc., of Fields Landing, Calif. 95537-0365, and at www.eti-usa.com. The plaster of Paris and epoxy treatments are affordable, permitting cost-effective fabrication of the articles.

Also, the treated article preferably is provided with a suitable string or line means for attaching to the completed article a shipping label bearing, for example, the destination address.

Accordingly, an interior plaster of Paris treatment, combined with an exterior resin coating, results in an unexpectedly effective retardation of the natural decomposition of the produce body by substantially limiting contact of the produce's organic material with air or ambient moisture. An article of produce treated according to the methods of this disclosure may appear fresh-picked for up three weeks, or sometimes longer, after initial treatment.

Attention is now invited to the drawing figures, in which like label numerals identify the same or similar apparatus elements throughout the various views. It must be understood that processes and methods are disclosed hereby as being performed by various and selected steps. The steps of any process or procedure in accordance herewith are not necessarily performed in any particular order, there being provided overall procedural guidance for making the products according the disclosure. Except as expressly limited in the claims appended hereto, the steps recited for the methods of this disclosure may be performed in different orders or sequences corresponding to various different embodiments. A person of skill in the art will recognize that the sequence of steps may vary from those disclosed hereinafter without departing from the scope and spirit of the invention, as limited solely by sequence limitations required by the claims hereinafter.

Figure 2:
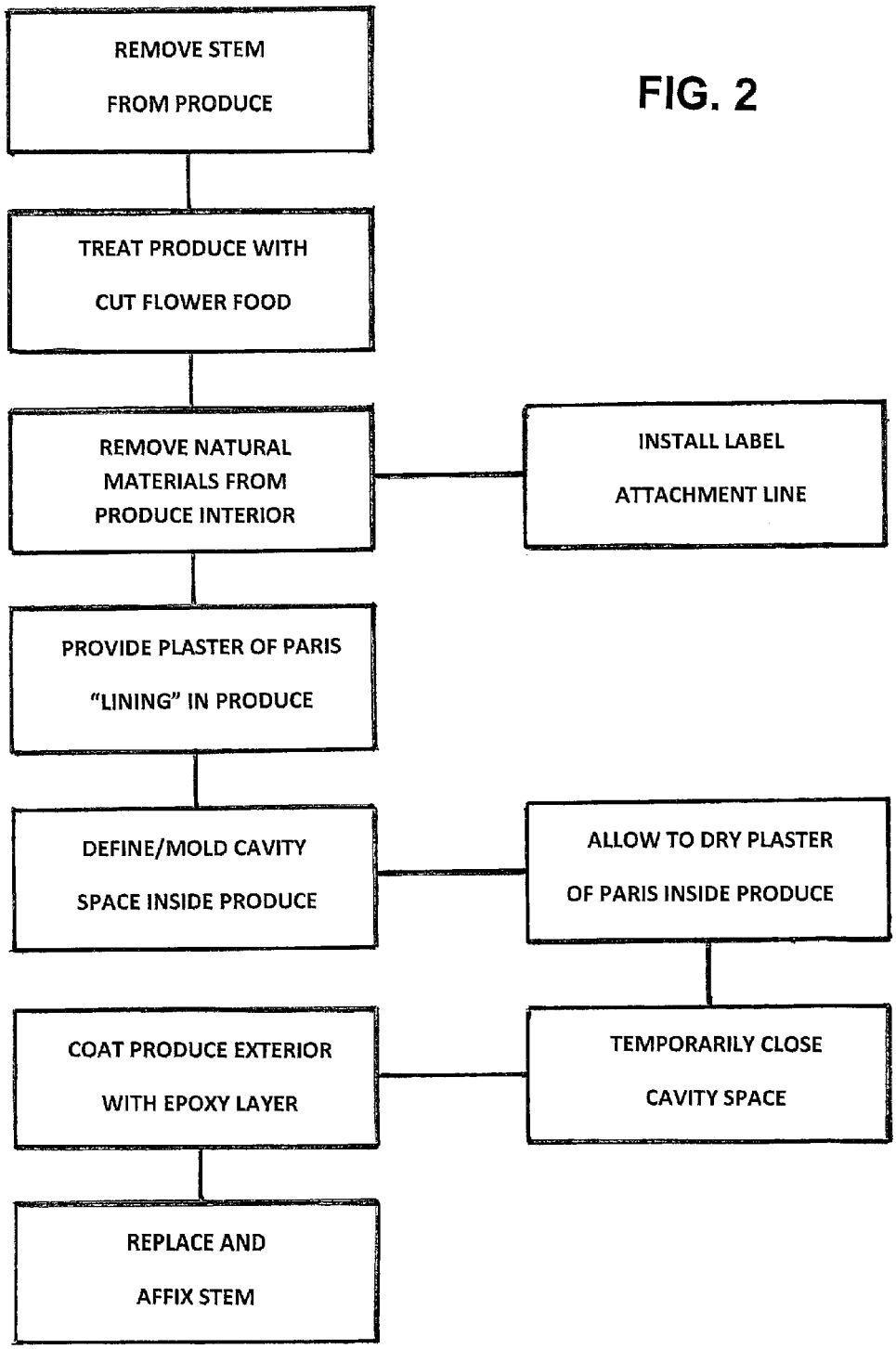
FIG. 2 is a schematic chart depicting selected principal steps of a method according to the invention for making a mailing container from an article of produce.

FIGS. 1 and 2 are flowcharts summarizing processes according to the invention for making novelty mailing items. FIG. 1 offers general procedural guidance for a method for making a produce "postcard." FIG. 2 is a flowchart generalizing a method for making a produce mailing "container." The first five summary steps of the fabrication methods for the two categories of novelty mailing items are substantially similar, as indicated by combined reference to FIGS. 1 and 2. The initial preparation steps, installation of a label attachment line, and provision of a plaster of Paris liner in the produce are about the same for the respective two types of produce mailing novelties. Consequently, reference initially is made jointly to FIGS. 1 and 2.

A clean, fresh article of produce 10 or 10' is first provided (FIGS. 3 and 4). As indicated by the first box in FIGS. 1 and 2, the produce stem 14 is removed (also see FIGS. 5A and 5B), as with a sharp knife, and set aside and dried separately for later use. By "stem" we mean not only the vascular stem itself, but a significantly sized, somewhat disk-shaped, fragment of that portion of the produce wall surrounding the stem where the stem joins the body of the produce (see FIGS. 3, 4, 5A and 5B). The stem and associated fragment are carefully removed as a single piece, as they are later to be replaced upon the body, preferably in a manner as to obscure that they were ever removed. The removal of the stem 14 opens the stem end of the produce to allow access to its hollow interior 22. A second generalized step suggested in FIGS. 1 and 2 is to treat the article of produce by immersing it in a florist's cut flowers "food," of the type commonly mixed with water for use in containers holding freshly cut flowers. A florist's preservative/food suitable for use in this regard is, for example, CHRYSAL® brand Clear Universal flower food commercially available from Chrysal Americas of Miami, Fla. 33172, and at www.chrysalusa.com. After the article 10, 10' is soaked for a time in an aqueous solution of a florist's cut flowers preservative-food, it is removed from the solution and drained.

FIGS. 1 and 2 indicate a next step of removing organic materials naturally found in the article. Such natural materials include but are not necessarily limited to loose pulp, veins and vessels, and seeds. They may be discarded. This removal may be accomplished any effective way, such as by manually scraping and scooping, and/or by vacuumed evacuation, via the opening 23 in the stem end 13 (FIGS. 5A and 5B).

After the article 10, 10' has been removed from the preservative solution and drained, the next step optionally but preferably is the installation of a label attachment line 16 on the produce, very preferably on the tip end of the produce 11, opposite the stem end 13. The attachment line 16 preferably is a flexible string or thin cord, such as (preferably) a 4-pound test monofilament polymer line. The label attachment line 16 provides a desirable element to which a mailing address label 38 or card may be attached; it also may serve incidentally as an acceptable line for suspending the article of produce in the air during drying steps of the fabrication process.

Figure 5A:
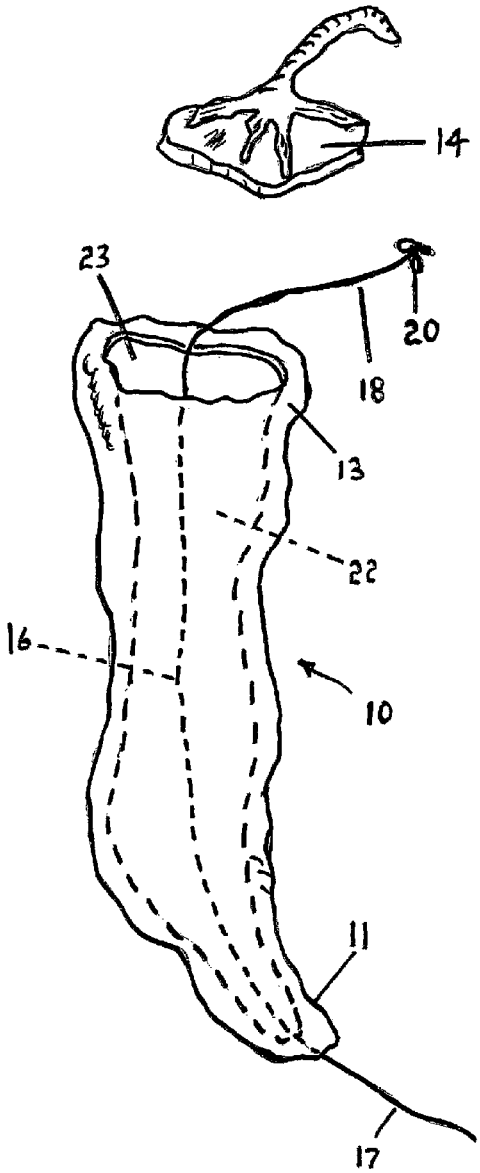
FIG. 5A is a side partially exploded view of a novelty mailing item according to the present invention, with phantom lines showing certain interior aspects thereof, including a label attachment line in a first position for attachment of an anchor.
Figure 5B:
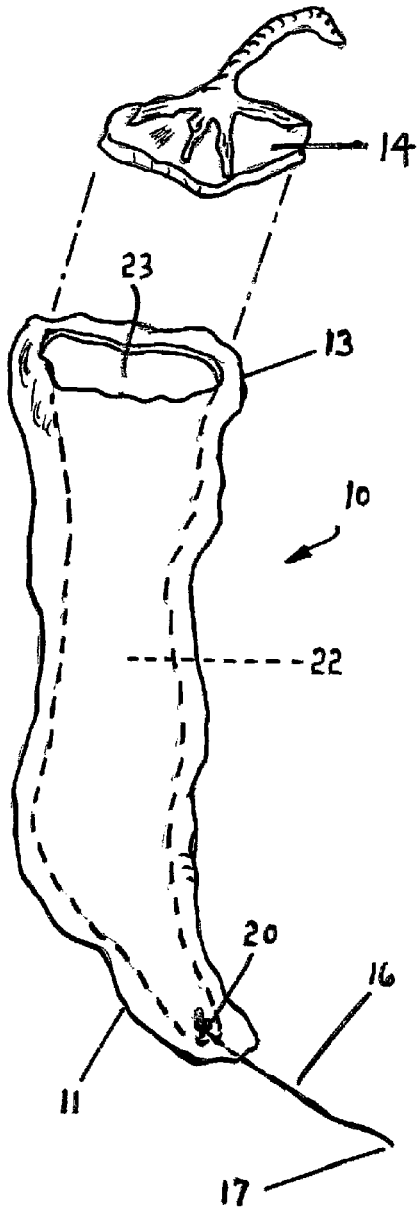
FIG. 5B is a side partially exploded view of a novelty mailing item seen in FIG. 5A, with phantom lines showing certain interior aspects thereof, including a label attachment line in a second position for being secured in the produce.

AS suggested by FIG. 5A, installation of the label attachment line 16 may be performed by disposing through the stem end 13, and into the produce interior 22, the label attachment line. The disposal may be accomplished by attaching the line 16 to a needle (e.g., by means of an eye in the needle), and penetrating the produce tip 11 with the needle to draw the line into the produce interior. This activity may be facilitated by manipulating the needle and line, while in the produce interior 22, via that opening 23 in the produce stem end 13 created by the removal of the stem 14. The label attachment line thus has an end 17 "exterior" to the produce 10 and an end 18 "interior" to the produce, the interior end 18 having been drawn into the interior 22 by the action of the piercing needle. The needle is removed from the line 16, and the interior end 18 is provided with an anchor 20. This anchor 20 may be as simple as, preferably, tying a substantial knot in the interior end 18 of the line 16. Alternatively, a small anchor piece 20, such as a tiny washer, small bead, or miniature dowel or the like, may be attached to the interior end 18. Attachment of such an anchor item may be by tying, adhesive, or etc. The anchor 20 is then secured within the hollow interior 22 of the produce, preferably at the tip end 11. This may be accomplished by pulling on the exterior end 17 of the label attachment line 16 to draw the anchor 20 into contact with the interior wall of the produce tip end 11 (FIG. 5B). A preferable next step is the filling the inside of the tip end 11 with a material, such as plaster of Paris, to hold the anchor 20 in place.

Figure 4B:
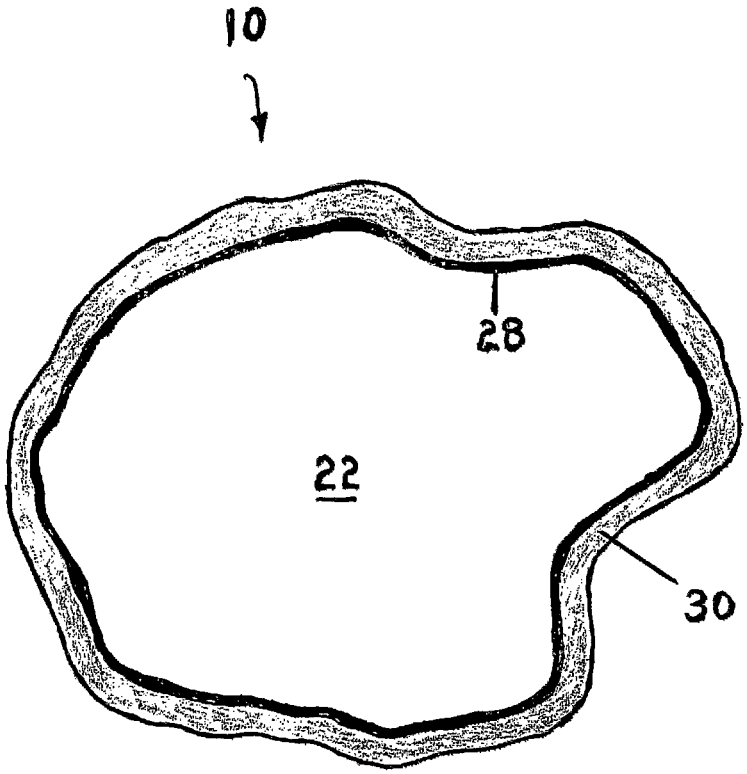
FIG. 4B is a sectional view of a chili pepper mailing container, similar to the view of FIG. 4A, at an intermediate stage of fabrication and showing a thin plaster of Paris liner on the interior of the pepper body wall.

Referring again to FIGS. 1 and 2, the process is generally characterized with a step of then providing a plaster of Paris "lining" 28 on the inside wall 30 of the produce interior. This may be accomplished by rewetting the produce (or at least the inside wall of its interior), packing dry plaster of Paris powder into the interior of the produce, and thus allowing the powder to come into contact with the wet interior wall 30. A thin layer of wetted plaster of Paris is created against and along the inside wall 30 of the produce 10. This thin layer of wetted plaster is allowed to dry/harden for a short time, and the bulk of the powder, still dry and loose, is then removed (as by pouring) from the produce interior 22, leaving a thin layer, i.e., a lining, of wet but hardening plaster of Paris on the inside walls of the produce. FIG. 4B depicts a cross section of the produce body 10 at this intermediate stage of processing, the wall 30 having the liner 28 hardening therein, but before any other plaster fillings or polymer/epoxy coatings are applied. Allowed to dry, this layer of plaster of Paris hardens to a thin liner 28 (FIGS. 3A, 4B) to strengthen and help preserve the produce body 10 or 10'.

At this procedural juncture, the methods diverge for making a novelty postcard and a novelty container. FIG. 1 depicts selected major remaining steps for completing a postcard, while FIG. 2 provides an overview for completing the fabrication of a novelty produce mailing container.

Referring to FIG. 1, the next generalized step in making a novelty postcard is to substantially fill the produce 10' with plaster of Paris. A wet plaster of Paris mix is placed in the interior 22 of the produce mostly or completely to fill it. The produce is set upright (stem end 13 up), and the plaster of Paris filling is allowed to dry. Drying can be for an extended period (e.g., overnight) at a moderate temperature, and/or for a relatively shorter time at higher temperature (e.g., about 90° F. to 100° F.).

Preferably after the plaster of Paris filling 27 is substantially dry, FIG. 1 indicates that the stem 14 is affixed to the stem end 13 of the produce 10'. The stem 14 preferably is restored to its original location covering the opening 23, in a manner as to conceal as best as possible the fact that the stem was ever removed from the produce. The stem 14 is affixed in position with, for example, an epoxy adhesive.

Nearing the completion of the making process, FIG. 1 indicates a major step of coating the produce with a layer 32 of epoxy. This is accomplished preferably by dipping the filled produce 10', with stem affixed, in an unhardened viscous epoxy resin mix. Very most preferably, the epoxy mix cures and hardens substantially clear and transparent, so that the natural appearance of the produce is preserved for viewing. An acceptable mix kit for this purpose is the ENVIROTEX LITE® polymer resin mix from Environmental Technology, Inc. All epoxies used in the method preferably cure to a clear, transparent, coating. The epoxy resin is mixed with its associated hardener, and while still "wet" but thick, the produce 10' is immersed in it and removed, leaving a thin coating of epoxy to cover the entire produce exterior. The epoxy coat 32 is then allowed to cure adequately to harden, e.g., overnight. During the drying/curing of the exterior epoxy coat, the produce preferably is hung by its tip end 11 (e.g., by the label attachment line), stem end 13 down.

Attention is invited to FIG. 2, depicting highlights from the remaining procedure for making a produce container novelty. After the thin plaster of Paris liner 28 is substantially dry, a cavity space 35 is defined inside the produce 10 by molding a plaster of Paris filling. The cavity space 35 is to be used to hold and contain the item (gift, note, etc.) to be transmitted in the container novelty.

A possible mode for defining the cavity space 35 is to use a plug mold in a soft plaster of Paris filling in the produce. A wet plaster of Paris mix is placed (e.g., by pouring) into the interior 22 of the produce to fill the majority (for example between about 50% and about 75%) of the volume of the produce interior. After the wet mix has been allowed to partially harden/thicken (after, for example, about nine to ten minutes) a plug mold, having the exterior dimensions and shape corresponding to the desired size and shape of the cavity space 35, is inserted into the viscous unhardened plaster of Paris filling 29, and then quickly withdrawn. When the plug mold is inserted, the consequently displaced wet plaster mix preferably substantially fills 29 the entire interior of the produce. When the plug mold is withdrawn, the topmost surface of the plaster mix 29 is substantially level or flush with the inner portion of the stem end 13 of the produce body 10. The withdrawal of the plug mold leaves an open cavity space 35 defined in the plaster of Paris mix 29. (See FIG. 4A.) The cavity space opens to the exterior of the produce body 10 via the opening 23 in the stem end corresponding to the removed stem 14.

The plug mold preferably comprises a material with a hydrophobic exterior surface or film/coating to reduce the tendency for plaster to stick thereto. Further, the plug mold should have a generally uniform lateral/radial cross section to promote easy withdrawal from the mix. The inventors have determined that, when fabricating is done manually, an ordinary wax candle of suitable size (e.g., about 0.75 to about 1.5 inches in diameter and a few inches long) and shape (e.g., cylinder) serves well as a plug mold. Further, wax plug molds can be readily shaped (e.g., carved or molded) to customize the shape of the resulting cavity space. For example, the plug mold may be conically shaped, and then be inserted apex-first into the mix filling to create a cavity space with a narrow bottom and broad top (opening).

FIGS. 2 and 4A show that after the cavity space creation, the plaster of Paris filling 29 (with the cavity space 35 defined therein) is allowed to dry and harden. Drying preferably occurs with the produce upright (stem end 13 upwards). Drying can be for a comparatively longer period (e.g., overnight) at a moderate temperature, and/or for a relatively shorter time at higher temperature (e.g., about 90° F. to 100° F.).

Prior to applying a polymer or epoxy coating to the produce container, it is expedient to close temporarily the opening 23 in the stem end 13 of the produce to prevent an unhardened resin mix from entering the cavity space 35. The temporary closing may be accomplished in any suitable manner which permits the closure to be easily reversed after the exterior epoxy coating is applied. For example, the cavity 35 and stem end opening 23 may be closed by filling/plugging the cavity space with a dense closed-cell urethane/polyurethane foam, soft modeling clay, crumpled paper/lightweight cardboard, wax or plastic plug or the like, shaped to substantially seal the cavity space opening against the flowing entry of wet epoxy resin mix.

FIG. 2 also shows that with the stem end opening 23 temporarily closed, the epoxy coating is applied to the produce. Like the produce postcard embodiment, this preferably is accomplished by quickly dipping and withdrawing the produce 10 from a viscous but still "wet" epoxy mix. Preferably the same epoxy resin mix kit is used as disclosed hereinabove for the produce postcard. The detached stem 14 is dipped at or about the same time as its associated produce body 10. After the epoxy coating 32 is applied it then is allowed to cure adequately to harden, e.g., overnight. During the drying of the exterior epoxy coat 32, the produce 10 preferably is hung by its tip end 11 (e.g., by the label attachment line), stem end down.

After all plasters and epoxies have dried to harden, a (sufficiently small) item may be inserted into the cavity space 35. The epoxy-coated stem 14 is then affixed to the produce stem end 13, so as to cover and close the correspondingly shaped and sized opening 23 that resulted from the stem's initial removal. The manner for affixing the replaced stem 14 preferably is one that is reasonably readily reversible or destructible, so that a recipient of the novelty produce mailing container can detach the stem 14 with little difficulty to retrieve the item from within the cavity space 35. A practical yet elegant manner for affixing the stem 14 in this regard is by means of a hot wax or paraffin seal; such a closure serves as an adhesive between the stem 14 and the produce body 10 that effectively seals the junction, preferably provides a tamper-evident seal, and yet also can be easily severed/opened manually, perhaps merely with a fingernail or earnest tug on the stem.

Preferred methods for making a novelty mailing item are now somewhat more specifically disclosed, with ongoing concurrent reference to the drawing figures. The practice of the methods begins with providing a produce 10 having a tip end 11, a substantially hollow interior 22, a stem end 13, and a stem 14. As mentioned, the step of providing a produce 10 (or 10') preferably comprises providing a chili pepper, such as those depicted in FIGS. 3 and 4. Any of a variety of peppers, including bell peppers, may be employed depending upon the desired aesthetic effect, including green, orange, and red peppers in the options available.

The stem 14 is removed from the produce, allowing access the hollow interior 22 by an opening in the stem end 13. The removal is done carefully with, for example, a sharp knife. The removal of the stem 14 creates an opening 23 in the stem end 13 of the produce. The stem 14 is dried separately from the produce body. For example, the wet stem 14 may be placed in a dry plaster of Paris powder, and allowed to dry therein for at least about six hours (e.g., overnight), preferably at a cooler temperature, for example within a range from about 55° F. to about 60° F.

The produce 10 (not including the stem 14) commences soaking in an aqueous solution of cut flower preservative. The soaking preferably is for a period of between about four hours and about 48 hours. Various cut flower foods are known and usable in the invention. An acceptable food for this soaking step is CHRYSAL® Clear Universal flower food powder, mixed, for example, at about one packet of preservative powder per quart of water, to form the aqueous solution in which the produce 10 is soaked.

The cut flower preservative solution is then drained from the produce 10, so that the article of produce preferably is only slightly damp. The produce 10 is then further treated by removing natural materials, such as any seeds and vein materials, from its hollow interior.

A label attachment line 16 is disposed through the produce tip end 11, and into the produce interior. The label attachment line 16 thereby has an end 17 exterior to the produce body 10, and an end 18 interior to the produce. (See FIG. 5A) The label attachment line 16 may be, and preferably is, a monofilament line, such as a test 4-lb fishing type line. Other thin, flexible string or line may be used. An anchor 20, such as a sizeable knot, or a small bead tied to the line 16, is provided on the interior end 18 of the label attachment line. For this purpose, the interior end 18 of the line may be manipulated outside the interior space 22 of the produce, via the opening 23 in the stem end 13 as seen in FIG. 5A.

There is then a step of securing the anchor 20 at the tip end 11 and within the hollow interior of the produce 10. This optionally is accomplished by drawing the anchor 20 against the tip end 11, as seen in FIG. 5B, and then pouring or otherwise placing a quantity of wet plaster of Paris (or a suitable alternative adhesive) into the tip end interior and around the anchor, as further disclosed herein.

The process continues with a light wetting of the interior of the produce 10, that is, a spraying or sprinkling of water onto the inside of the walls 30 of the produce body 10. The interior of the produce 10 is substantially filled with dry plaster of Paris powder, such that a portion of the dry plaster of Paris powder is wetted by coming into contact with the wetted walls 30 of the interior of the produce 10.

That portion of the dry plaster of Paris wetted by contact with the wetted produce interior is allowed partially to harden by reaction with the moisture on the inside of the produce wall 30. This partial hardening time may be, for approximate example, about ten to fifteen minutes. This is followed by a removing (e.g., pouring) from the interior of the produce 10 all dry, unhardened, plaster of Paris powder, thereby to leave unfilled a portion of the produce interior. The plaster of Paris remaining within the produce interior (i.e., partially hardened upon the interior walls 30 of the produce 10) is allowed to dry and substantially further to harden, which may require as little as five additional minutes of drying time. This step of allowing to dry and to harden effectively creates a thin, hard, plaster of Paris lining 28 covering most or all the inside wall 30 of the produce interior. After this plaster of Paris "lining" 28 has been allowed to harden, the remaining unfilled portion of the produce interior is at least partially filled with a second wet plaster of Paris mix, which subsequently is allowed to dry and harden, as disclosed further herein. Finally to the basic process there is a step of coating the produce with a layer 32 of epoxy.

The step of drying the stem 14 preferably comprises the added steps of wetting the stem 14 with water, surrounding the stem with dry plaster of Paris powder for a time (e.g., at least about six hours), and then removing the stem from the dry plaster of Paris powder. This step of surrounding the stem 14 further preferably involves maintaining the stem at a temperature of between approximately 50° F. and approximately 60° F. while the drying occurs. When dry, the stem 14 is set aside and later will be replaced upon the produce 10 as part of completing the fabrication process.

The described step of soaking the produce 10 preferably includes soaking for an immersion time period of between approximately four hours and approximately 48 hours.

In one embodiment, the step of disposing a label attachment line 16 includes steps of penetrating the tip end 11 with a needle, and therewith pulling the label attachment line. Again, the label attachment line 16 preferably but not exclusively is a polymer monofilament line. An anchor 20 is provided on the line 16, and providing the anchor in a preferred process means tying a knot in the interior end 18 of the label attachment line 16. The anchor provision step may be accomplished with the interior end 18 of the line 16 exposed outside the produce 10 via exteriorization via the opening 22 in the stem end of the produce, as seen in FIG. 5A. After the anchor 16 is provided on the interior end 18, it may be drawn into contact with the inside of the tip end 11 of the produce by carefully pulling upon the exterior end 17 of the line 16, as suggested by FIG. 5B.

The method preferably includes the step of securing the anchor 16 to the produce. Securing the anchor may feature the additional steps of: placing a first wet plaster of Paris mix within the interior space of the produce, at its tip end 11, so as to cover substantially the anchor 16 in its position in the inside of the tip end of the produce. Covering the anchor with the first wet plaster of Paris mix may mean filling the produce's interior hollow up to about 25% of the volume. In a preferred embodiment, a paint hardener of known type is added to this first plaster of Paris mix, so to reduce its hardening time (e.g., by up to 50%). The first plaster of Paris mix is then allowed substantially to dry; this drying time may be, for example, about 20 minutes.

After the step of allowing to dry the plaster of Paris remaining within the produce interior 22, that is, the thin plaster of Paris liner 28 on the produce interior, the produce 10 is again re-wetted. This rewetting is preparatory to the step of at least partially filling, with a second wet plaster of Paris mix, the unfilled portion of the produce interior.

The step of providing a chili pepper optionally includes providing a chili pepper 10' with a relatively flat outside surface portion 26 for accepting a written message. An example of such a pepper 10' is seen in FIGS. 3 and 3A. A relatively flattened pepper 10' or similarly shaped produce serves, when fully treated, as a novelty produce "postcard." For a postcard embodiment, the step of at least partially filling, with a second wet plaster of Paris mix, the unfilled portion of the produce interior, includes the steps of rewetting the pepper 10' (after the step of allowing to dry the plaster of Paris remaining within the produce interior), then substantially completely filling the unfilled portion of the produce interior with the second wet plaster of Paris mix. This second wet plaster of Paris mix is allowed to dry. This second wet plaster of Paris mix, after dried and substantially filling the produce 10' is shown as plaster filling 27 in FIG. 3A; FIG. 3A offers a cross-sectional view of the substantially completed produce postcard embodiment. (The thin liner 28 of plaster in the finished embodiment is between the plaster filling 27 and the wall 30 of the produce.) This drying may be accomplished effectively, for example, in a low temperature mode of at least six hours (e.g., overnight) at approximately room temperature. Or, an alternative drying mode for the second wet plaster of Paris mix, which substantially fills (27) the interior of the "postcard" produce 10', may be to dry the produce containing the second mix for approximately two hours at a temperature in the range of from approximately 90° F. to approximately 100° F.

In a further step of making the postcard embodiment of the novelty produce mailer, the stem 14 is replaced upon the produce 10. In replacing the stem, there is an affixing of the stem 14 to the stem end 13 of the chili pepper, to close substantially the opening 23 in the stem, Further, the step of coating the produce with a layer 32 of epoxy includes mixing together an epoxy resin and a hardener, and then, before the epoxy mixture hardens substantially (e.g., up to about 25 minutes), dipping briefly the chili pepper, with stem affixed, in the epoxy mixture to coat the chili pepper and stem with a layer of epoxy 32, and allowing the epoxy layer to harden.

The step of providing a chili pepper alternatively includes providing a relatively large chili pepper 10 (for example at least about four inches long and at least about two inches in average diameter or lateral breadth) that may be used to fabricate a novelty produce mailing container. An example is seen in FIG. 4. In the method of making a container, the step of at least partially filling, with a second wet plaster of Paris mix, the unfilled portion of the produce interior, may include the several steps of rewetting the chili (after the step of allowing to dry the plaster of Paris remaining within the produce interior), and then filling at least one-half (and up to about three-fourths) the volume of the unfilled portion of the produce interior with the second wet plaster of Paris mix. Before the second wet plaster mix substantially hardens (e.g., perhaps about nine minutes), a plug mold is inserted into the second wet plaster of Paris mix. The plug mold may be, by way of example, a wax candle or paraffin plug generally cylindrical in shape, and preferably approximately 0.75 to about 1.5 inches in diameter. After this second wet plaster mix has partially hardened (e.g., about 20 to 25 minutes), the plug mold is removed from the second wet plaster of Paris mix, thereby defining a cavity space 35 (FIGS. 4 and 4A) within the second plaster of Paris mix. The second wet plaster of Paris mix is allowed to dry; drying may be done, for example, overnight at room temperature or alternatively for about 2 hours at between 90° F. and about 100° F. The dried and hardened second wet plaster mix is seen as the filling 29 in FIG. 4A, which substantially surrounds and defines the cavity space 35. The cavity space 35 holds the knick-knack item that is transmitted in the produce container. FIG. 4A offers a cross-sectional view of the substantially completed produce container embodiment. (Again, the thin liner 28 of plaster in the finished embodiment is between the plaster filling 29 and the wall 30 of the produce.)

The novelty container embodiment of the produce mailer also preferably is coated with a layer of epoxy. Coating the produce container 10 with a layer of epoxy includes temporarily closing the opening in the stem end 13, so that unhardened epoxy will not enter the cavity space 35 during epoxy mix application. This temporary closing may be accomplished by stuffing soft modeling clay, or the like, into the cavity space to seal it against the entry of the viscous epoxy mix. (After the coating of epoxy has been applied, the clay plug or the like is removed to unclose the cavity space 35.) A suitable epoxy resin and a hardener are mixed. Before the epoxy mixture hardens substantially (for example, up to about 25 minutes after mixing), the chili pepper 10 is dipped briefly in the epoxy mixture to coat the chili pepper with a layer of epoxy 32. Likewise, and at generally the same time, (and before the epoxy mixture hardens substantially), the separate stem 14 for the container produce is dipped in the epoxy mixture to coat the stem with a layer of epoxy. These epoxy layers are then allowed to cure. The making of a container produce such as chili pepper 10 preferably includes additional steps of unclosing the opening in the stem end 13.

The novelty mailing container may be completed for use by inserting an item (gift, rolled paper message, or the like) into the cavity space 35, placing the stem 14 on the stem end 13 of the chili pepper 10 to close substantially the opening in the stem end, and then removably securing the stem to the stem end of the chili pepper. For example, the stem 14 can be secured to the stem end, to close the opening, by placing the stem substantially in its natural original position, and then using melted sealing wax to affix it in place.

In both embodiments of the novelty mailer, the postcard embodiment and the container embodiment, a mailing label or address card 38 may be securely attached, as by tying, to the exterior end 17 of the label attachment line, as seen in FIGS. 3 and 4, prior to mailing. Postage stamps may also be placed thereon, or directly upon the postcard or container produce. Particularly in the case of the postcard embodiment of the produce 10', a message may be written upon the writing surface 26 prior to mailing.

Accordingly, there is provided methods for making a novelty mailing produce postcard 10', or a novelty produce mailing parcel or container 10 that is reasonably durable and attractive, for sending to a friend, family, or other addressee. Having been so treated, including with plaster of Paris and epoxy, the produce will remain preserved at least long enough to be shipped substantial distances by mail or courier, to be received with delight by the recipient.

Although the invention has been described in detail with particular reference to these preferred embodiments, other embodiments can achieve the same results. Variations and modifications of the present invention will be obvious to those skilled in the art, and it is intended to cover in the appended claims all such modifications and equivalents.

What is claimed is:

1. A method for making a novelty mailing item comprising the steps of:

providing a produce having a tip end, a substantially hollow interior, a stem end, and a stem;

removing the stem from the produce, allowing access the hollow interior by an opening in the stem end;

drying the stem;

soaking the produce in an aqueous solution of cut flower preservative;

draining the cut flower preservative solution from the produce;

removing natural materials from the hollow interior;

disposing through the tip end, and into the interior, a label attachment line, the label attachment line thereby having an end exterior to the produce and an end interior to the produce;

providing an anchor on the interior end of the label attachment line;

securing the anchor at the tip end within the hollow interior of the produce;

lightly wetting the interior of the produce;

substantially filling the interior of the produce with dry plaster of Paris powder, whereby a portion of the dry plaster of Paris powder is wetted by contact with the wetted produce interior;

allowing partially to harden that portion of the dry plaster of Paris wetted by contact with the wetted produce interior;

removing from the interior all unhardened plaster of Paris powder to leave an unfilled portion of the produce interior;

allowing to dry and substantially completely harden the plaster of Paris remaining within the produce interior;

at least partially filling, with a second wet plaster of Paris mix, the unfilled portion of the produce interior; and coating the produce with a layer of epoxy.

2. The method according to claim 1 wherein the step of providing a produce comprises providing a chili pepper.

3. The method according to claim 1 wherein the step of drying the stem comprises:

wetting the stem;

surrounding the stem with dry plaster of Paris powder for at least six hours; and removing the stem from the dry plaster of Paris powder.

4. The method according to claim 3 wherein the step of surrounding the stem further comprises maintaining the stem at a temperature of between approximately 50° F. and approximately 60° F.

5. The method according to claim 1 wherein the step of soaking the produce comprises soaking for a time period between approximately four hours and approximately 48 hours.

6. The method according to claim 1 wherein the step of disposing a label attachment line comprises penetrating the tip end with a needle pulling a label attachment line, wherein the label attachment line comprises a polymer monofilament line.

7. The method according to claim 1 wherein the step of providing an anchor comprises tying a knot in the interior end of the label attachment line.

8. The method according to claim 1 wherein the step of securing the anchor comprises the steps of:

placing a first wet plaster of Paris mix within the interior space at the tip end, so to cover the anchor; and allowing the first plaster of Paris mix substantially to dry.

9. The method according to claim 8 comprising the further step of mixing paint hardener with the first wet plaster of Paris mix.

10. The method according to claim 1 wherein the step of allowing to dry and substantially to harden comprises waiting approximately 15 minutes.

11. The method according to claim 3 wherein the step of providing a chili pepper comprises providing a chili pepper with a relatively flat outside surface for accepting a written message, and the step of at least partially filling, with a second wet plaster of Paris mix, the unfilled portion of the produce interior, comprises:

rewetting the chili after the step of allowing to dry the plaster of Paris remaining within the produce interior;

substantially completely filling the unfilled portion of the produce interior with the second wet plaster of Paris mix; and allowing the second wet plaster of Paris mix to dry.

12. The method according to claim 11 comprising the further step of affixing the stem to the stem end of the chili pepper to close substantially the opening in the stem end, and wherein the step of coating the produce with a layer of epoxy comprises:

mixing together an epoxy resin and a hardener;

before the epoxy mixture hardens substantially, dipping briefly the chili pepper, with stem affixed, in the epoxy mixture to coat the chili pepper and stem with a layer of epoxy; and allowing the epoxy layer to harden.

13. The method according to claim 3 wherein the step of providing a chili pepper comprises providing a relatively large chili pepper, and the step of at least partially filling, with a second wet plaster of Paris mix, the unfilled portion of the produce interior, comprises:

rewetting the chili after the step of allowing to dry the plaster of Paris remaining within the produce interior;

filling at least one-half the volume of the unfilled portion of the produce interior with the second wet plaster of Paris mix;

before the second wet plaster mix substantially hardens, inserting a plug mold into the second wet plaster of Paris mix;

after the second wet plaster mix has partially hardened, removing the plug mold from the second wet plaster of Paris mix, thereby defining a cavity space within the second plaster of Paris mix; and allowing the second wet plaster of Paris mix to dry.

14. The method according to claim 13 wherein the step of coating the produce with a layer of epoxy comprises:

temporarily closing the opening in the stem end;

mixing together an epoxy resin and a hardener;

before the epoxy mixture hardens substantially, dipping briefly the chili pepper in the epoxy mixture to coat the chili pepper with a layer of epoxy;

before the epoxy mixture hardens substantially, dipping briefly the stem in the epoxy mixture to coat the stem with a layer of epoxy; and allowing the epoxy layers to harden.

15. The method according to claim 14 further comprising the steps of:

unclosing the opening in the stem end;

inserting an item into the cavity space;

placing the stem on the stem end of the chili pepper to close substantially the opening in the stem end; and removably securing the stem to the stem end of the chili pepper.

16. A novelty mailing item made by the method of claim 1.

17. A novelty mailing item made by the method of claim 15.

* * * * *